US006801740B2

(12) United States Patent
Ito et al.

(10) Patent No.: US 6,801,740 B2
(45) Date of Patent: Oct. 5, 2004

(54) DEVELOPING DEVICE AND ELECTROPHOTOGRAPHIC APPARATUS

(75) Inventors: Katsuyuki Ito, Tokyo (JP); Takuya Goto, Tokyo (JP); Kentaro Hasegawa, Tokyo (JP); Takanori Mimura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 24 days.

(21) Appl. No.: 10/616,084

(22) Filed: Jul. 8, 2003

(65) Prior Publication Data

US 2004/0009018 A1 Jan. 15, 2004

(30) Foreign Application Priority Data

Jul. 12, 2002 (JP) ..... 2002-203534

(51) Int. Cl.[7] ..... G03G 15/08
(52) U.S. Cl. ..... 399/284
(58) Field of Search ..... 399/119, 252, 399/258, 264, 281, 283, 284

(56) References Cited

U.S. PATENT DOCUMENTS 5,404,211 A * 4/1995 Hashimoto et al. ..... 399/126
5,570,164 A * 10/1996 Yamamoto et al. ..... 399/283

FOREIGN PATENT DOCUMENTS

| | | |
|---|---|---|
| EP | 0 682 296 A2 | 11/1995 |
| JP | 07044007 | 2/1995 |
| JP | 07-044007 A | 2/1995 |
| JP | 07-064394 A | 3/1995 |
| JP | 09-080905 A | 3/1997 |
| JP | 10-153910 A | 6/1998 |
| JP | 2000-098740 A | 4/2000 |
| JP | 2000098740 | 4/2000 |
| JP | 2001-056605 A | 2/2001 |
| JP | 2002023493 | 1/2002 |

* cited by examiner

*Primary Examiner*—Hoang Ngo
(74) *Attorney, Agent, or Firm*—Akin Gump Strauss Hauer & Feld, L.L.P.

(57) ABSTRACT

A developing device 4 includes a developing roller 10 that faces a drum 1, a supplying roller 11 that supplies the toner to the developing roller 10, and a toner container 15 for storing the toner. A toner layer forming roller 12 contacts the developing roller 10 and rotates in the same direction as the developing roller 10. A part of the toner is transferred from the developing roller 10 to the peripheral surface of the toner layer forming roller 12 to form a toner layer. The thickness of the toner layer on the toner layer forming roller 12 is regulated by a blade 13. According to the rotation of the toner layer forming roller 12, the toner layer is carried outside the toner container 15, where the toner layer is transferred to the peripheral surface of the developing roller 10.

26 Claims, 9 Drawing Sheets

| DEPTH OF DENT (μm) | GENERATION OF LATERAL STRIPE | | | | |
|---|---|---|---|---|---|
| | PUSHING AMOUNT 0.1mm | PUSHING AMOUNT 0.2mm | PUSHING AMOUNT 0.3mm | PUSHING AMOUNT 0.4mm | PUSHING AMOUNT 0.5mm |
| 0 | NONE | NONE | NONE | NONE | UNABLE TO ROTATE |
| 3 | OBSERVED | NONE | NONE | NONE | |
| 5 | OBSERVED | NONE | NONE | NONE | |
| 8 | OBSERVED | NONE | NONE | NONE | |
| 10 | OBSERVED | SLIGHTLY OBSERVED | NONE | NONE | |

FIG.11

| PRINTED PAGE | THICKNESS OF TONER LAYER ON DEVELOPING ROLLER (mg/cm²) | | |
|---|---|---|---|
| | PUSHING AMOUNT 0.1mm | PUSHING AMOUNT 0.2mm | PUSHING AMOUNT 0.3mm |
| 0 | 0.5 | 0.5 | 0.5 |
| 5,000 | 0.55 | 0.5 | 0.5 |
| 10,000 | 0.6 | 0.5 | 0.5 |
| 15,000 | 0.62 | 0.5 | 0.5 |
| 20,000 | 0.63 | 0.5 | 0.5 |

FIG.14

| DEPTH OF DENT (μm) | GENERATION OF LATERAL STRIPE | |
|---|---|---|
| | EMBODIMENT 4 PUSHING AMOUNT : 0.2mm | EMBODIMENT 5 |
| 0 | NONE | NONE |
| 3 | NONE | NONE |
| 5 | NONE | NONE |
| 8 | NONE | NONE |
| 10 | SLIGHTLY OBSERVED | NONE |

FIG.15

| PRINTED PAGES | THICKNESS OF TONER LAYER ON DEVELOPING ROLLER (mg/cm²) | |
|---|---|---|
| | EMBODIMENT 4 PUSHING AMOUNT : 0.2mm | EMBODIMENT 5 |
| 0 | 0.5 | 0.5 |
| 5,000 | 0.5 | 0.5 |
| 10,000 | 0.5 | 0.5 |
| 15,000 | 0.5 | 0.5 |
| 20,000 | 0.5 | 0.5 |

DEVELOPING DEVICE AND ELECTROPHOTOGRAPHIC APPARATUS

BACKGROUND OF THE INVENTION

This invention relates to an electrophotographic apparatus employed in a printer, a copier and the like, and relates to a developing device that develops a latent image with a toner in the electrophotographic apparatus.

An electrophotographic apparatus employed in a printer, a copier and the like, has a developing device that develops a latent image formed on a photosensitive drum (i.e., a latent image bearing member) with a toner. There is a developing method called nonmagnetic single component development, in which a nonmagnetic toner is used and a carrier is not used. Developing devices applicable to this nonmagnetic single component development are disclosed, for example, in Japanese Laid-open Patent Publication Nos. HEI 7-44007, HEI 7-64394, HEI 9-80905, HEI 10-153910, HEI 12-98740 and HEI 13-56605.

FIG. 16 shows the developing device disclosed in Japanese Laid-open Patent Publication No. HEI 7-44007. The developing device includes a developing roller 100 that faces a photosensitive drum 110, and a supplying roller 111 that supplies the toner to the peripheral surface of the developing roller 100. A toner regulating roller 102 is disposed on the upper side of the developing roller 100 in FIG. 16. The toner regulating roller 102 regulates the thickness of the toner adhering to the peripheral surface of the photosensitive drum 110. A blade 103 contacts the peripheral surface of the toner regulating roller 102, for scraping the toner from the peripheral surface of the toner regulating roller 102. The toner, the thickness of which has been regulated by the toner regulating roller 102, is attracted by and adheres to a latent image formed on the photosensitive drum 110. After the toner on the developing roller 100 is transferred to the photosensitive drum 110, the residual toner (denoted by A) is removed by the recovering roller 104 disposed at the lower side of the developing roller 100 or the supplying roller 111. The developing devices disclosed in other publications have substantially the same basic constructions as that shown in FIG. 16.

In the conventional developing apparatus, the developing roller 100 carries the toner through a gap between the developing roller 100 and the toner regulating roller 102 to the photosensitive drum 110 side of the developing roller 100. Thus, in order to hold the toner layer on the peripheral surface of the developing roller 100, the friction coefficient of the peripheral surface of the developing roller 100 must be greater than that of the toner regulating roller 102. However, if the friction coefficient of the peripheral surface of the developing roller 100 is large, the releasability of the developing roller 100 against the toner (i.e., the easiness with which the toner is released from the developing roller 100) is low. Therefore, there is a case where the residual toner A on the peripheral surface of the developing roller 100 is not completely removed by the recovering roller 104 or the supplying roller 111. If the residual toner A remains on the peripheral surface of the developing roller 100, an additional toner adheres to the residual toner A when the developing roller 100 rotates once more, and the toner layer becomes partially thicker. The thicker part of the toner layer on the developing roller 100 may contact a part of the peripheral surface of the photosensitive drum 110 other than the latent image, so that an unintentional toner image is formed on the photosensitive drum 110. The unintentional toner image is transferred to a recording sheet, and forms a stain and the like (i.e., an afterimage) on the recording sheet, with the result that the quality of the image is degraded.

Further, the blade 103 is urged against the toner regulating roller 102 with a relatively large force, and may cause a so-called filming phenomenon where the toner is melted by the friction heat and adheres to the peripheral surface of the toner regulating roller 102 and the like. If such a filming phenomenon occurs, the thickness of the toner layer on the developing roller 100 becomes uneven, so that a stain or a defect in the image may be formed on the recording sheet, and therefore the quality of the image is degraded.

SUMMARY OF THE INVENTION

An object of the present invention is to provide a developing device and an electrophotographic apparatus capable of preventing degradation of the quality of an image.

According to the invention, there is provided a developing device including a developing member that develops a latent image formed on a latent image bearing member, a toner supplying member that supplies a toner to the developing member, and a toner layer forming member that has a peripheral surface contacting the developing member. The developing device further includes a toner layer regulating member that regulates the thickness of a toner layer that adheres to the peripheral surface of the toner layer forming member. The toner layer is transferred from the peripheral surface of the toner layer forming member to a peripheral surface of the developing member, after the thickness of the toner layer has been regulated by the toner layer regulating member.

With such an arrangement, the toner layer whose thickness has been regulated by the toner layer regulating member is transferred from the toner layer forming member to the developing member. Thus, even if the friction coefficient of the developing member is small, it is possible to uniformly form the toner layer having sufficient thickness on the peripheral surface of the developing member. As the peripheral surface of the developing member has a relatively small friction coefficient, it may increase the releasability of the developing member against the toner, and therefore it is ensured that the residual toner is thoroughly removed from the developing member. Thus, it is possible to prevent the occurrence of the afterimage caused by the residual toner on the developing member, and therefore it is possible to prevent the degradation of the quality of image.

Moreover, the toner layer regulating member is urged against the toner layer forming member with a relatively small force because it is unnecessary to completely remove the toner from the peripheral surface of the toner layer forming member. Thus, it is possible to prevent the occurrence of the filming phenomenon resulting from the melting of the toner due to the friction heat, and therefore the degradation of the quality of the image can be prevented. In addition, it is possible to vary the thickness of the toner layer formed on the peripheral surface of the developing member, by changing the friction coefficients, electric potentials and the like of the developing member and the toner layer forming member. As a result, the density of the printed image becomes variable.

BRIEF DESCRIPTION OF THE DRAWINGS

In the attached drawings:

FIG. 11 is a table illustrating the experimental result of the change in thickness of the toner layer formed on the developing roller;

FIG. 14 is a table illustrating the experimental result of the generation of the lateral stripe according to Embodiment 5 of the present invention;

FIG. 15 is a table illustrating the experimental result of the change in thickness of the toner layer formed on the developing roller according to Embodiment 5 of the present invention.

DETAILED DESCRIPTION OF THE INVENTION

Embodiments of the present invention will be described with reference to the attached drawings.

Embodiment 1.

Figure 1:
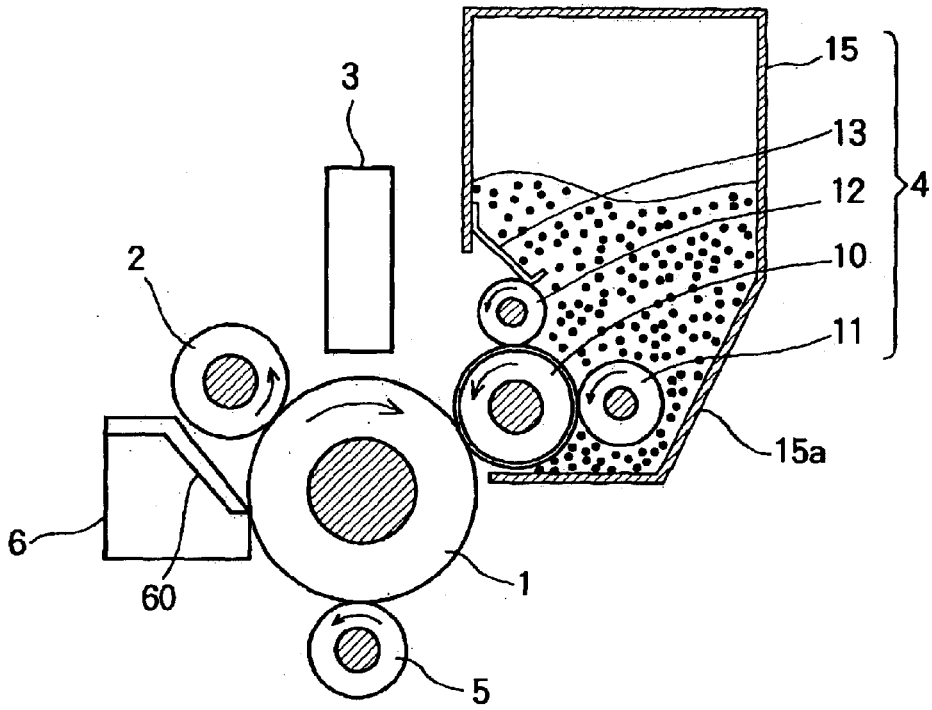
FIG. 1 is a sectional view of an electrophotographic apparatus including a developing device according to Embodiment 1 of the present invention.

FIG. 1 is a sectional view of the main part of an electrophotographic apparatus including a developing device according to Embodiment 1. The electrophotographic apparatus is of a type which uses a nonmagnetic single component development. The electrophotographic apparatus includes a photosensitive drum 1 (hereinafter, referred to as a drum 1) as a latent image bearing member. A photosensitive layer is formed on the peripheral surface of the drum 1. The photosensitive layer is insulative when the photosensitive layer is not exposed to the light, and becomes conductive when the photosensitive layer is exposed to the light so that the electric charge is released therefrom. The drum 1 rotates in one direction (i.e., clockwise in FIG. 1). Along the circumference of the drum 1, a charging roller 2, an LED head 3, a developing device 4, a transfer roller 5 and a cleaning unit 6 are arranged in the direction of the rotation of the drum 1.

The charging roller 2 is constructed of an electrically conductive roller and a uniform voltage is applied to the charging roller 2. The charging roller 2 contacts the peripheral surface of the drum 1 so as to uniformly charge the photosensitive layer on the peripheral surface of the drum 1. The LED head 3 has LEDs (Light Emitting Diodes) arranged in an array, and exposes the photosensitive layer of the drum 1 according to the image data. The electric charge is released from the exposed area of the photosensitive layer of the drum 1, while the electric charge remains on the non-exposed area, so that the latent image is formed. The developing device 4 develops the latent image in such a manner that the toner adheres to the latent image formed on the peripheral surface of the drum 1. The transfer roller 5 is disposed at the lower side of the drum 1 so that a recording sheet (a recording medium) is pinched by the transfer roller 5 and the drum 1. The transfer roller 5 transfers the toner image from the peripheral surface of the drum 1 to the recording sheet. The cleaning unit 6 has a cleaning blade 60 that removes the residual toner that remains on the peripheral surface of the drum 1 after the toner image is transferred to the recording sheet.

Figure 2:
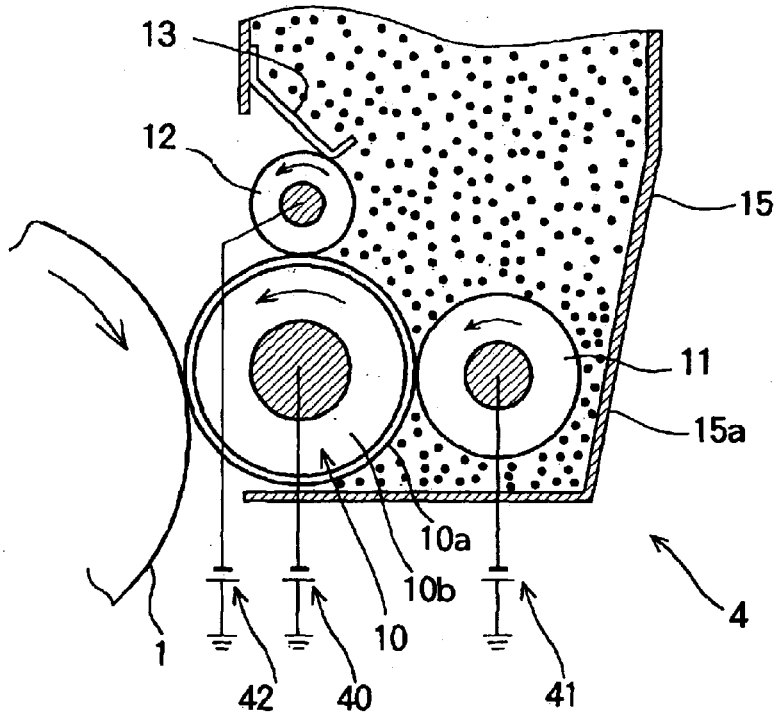
FIG. 2 is an enlarged view of the developing device according to Embodiment 1 of the present invention.

FIG. 2 is an enlarged view of the developing device 4. The developing device 4 includes a developing roller (a developing member) 10, a toner container 15 that stores the toner to be supplied to the developing roller 10. The developing roller 10 is disposed at the bottom of the toner container 15. A first part (right part as seen in FIG. 2) of the developing roller 10 is located in the toner container 15, and a second part (left part) of the developing roller 10 projects out of the toner container 15. The rotation axis of the developing roller 10 is in parallel to the rotation axis of the drum 1. The developing roller 10 rotates in the direction opposite to the direction of the rotation of the drum 1, so that the toner carried by the developing roller 10 adheres to the drum 1.

The developing roller 10 is constructed of a resilient roller **10*b* (to be more specific, a rubber roller) having a semiconductivity and a coating layer 10*a* formed on the peripheral surface of the resilient roller 10*b*. The coating layer 10*a* is made of a resin, for example, a polyimide resin, an urethane resin, or a fluorine resin. Because of the coating layer 10*a*, the surface roughness of the developing roller 10 is small, so that the releasability of the developing roller 10 against the toner (i.e., the easiness with which the toner is released from the developing roller 10) is improved. The JIS (Japanese Industrial Standard)-C hardness of the developing roller 10 ranges from 30 to 60. Alternatively, the developing roller 10** can be constructed of a roller made of a porous resin (for example, a sponge) covered by a tube of a polyimide resin and the like.

Figure 3:
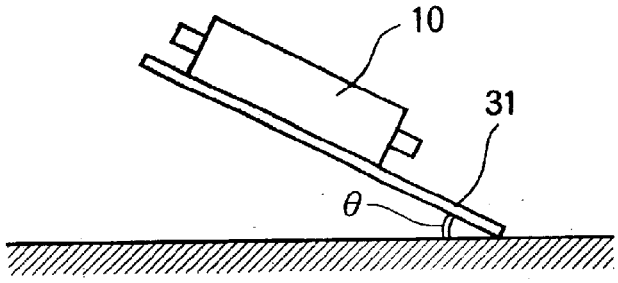
FIG. 3 is a schematic view illustrating the method for measuring the friction coefficient of a developing roller.

FIG. 3 is a schematic view illustrating a method for measuring the static friction coefficient of the peripheral surface of the developing roller 10. A tilting plate 31 made of an acryl resin is used in this measurement. The tilting plate 31 has a flat surface having an average surface roughness (Rz) of approximately 2 $\mu$m. The developing roller 10 is placed on the tilting plate 31 so that the axial direction of the developing roller 10 is aligned with the direction of the inclination of the tilting plate 31. By gradually increasing the tilt angle of the tilting plate 31, the tilt angle of the tilting plate 31 when the developing roller 10 starts sliding is defined as a sliding angle $\theta$ (greater than 0). The sliding angle $\theta$ and the static friction coefficient $\mu$ have the relationship of $\mu = \tan\theta$. It is preferable that the static friction coefficient $\mu$ of the developing roller 10 with respect to the tilting plate 31 is equal to or less than 0.58, i.e., the sliding angle $\theta$ is equal to or less than 30 degrees. It is further preferable that the static friction coefficient $\mu$ of the developing roller 10 with respect to the tilting plate 31 is equal to or less than 0.36, i.e., the sliding angle θ is equal to or less than 20 degrees.

As shown in FIG. 2, a supplying roller (a toner supplying member) 11 is disposed in the proximity of the developing roller 10. The supplying roller 11 has a rotation axis in parallel to the rotation axis of the developing roller 10. The supplying roller 11 is constructed of a semi-conductive resin having intercommunicating pores, and more specifically, a so-called urethane sponge. The peripheral surface of the supplying roller 11 contacts the peripheral surface of the developing roller 10. The rotational direction of the supplying roller 11 is the same as that of the developing roller 10.

Electric sources 40 and 41 respectively apply electric potentials VD and VS to the developing roller 10 and the supplying roller 11. There is a difference between the electric potentials VD and VS so that the toner is attracted by the developing roller 10. To be more specific, in the case where the toner is negatively charged because of frictional electrification (described later), the electric potentials VD and VS are set to negative values. Conversely, in the case where the toner is positively charged, the electric potentials VD and VS are set to positive values. The electric potentials VD and VS satisfy the relationship $|VD| \leqq |VS|$. Hereinafter, the electric potentials VD and VS are determined based on the assumption that the toner is negatively charged. For example, the electric potential VD is set to −300V, and the electric potential VS is set to −450V. Conversely, if the toner is positively charged, the electric potentials VD and VS are respectively set to, for example, +300V and +450V.

An inclination wall 15a is formed at the lower part of the toner container 15. The inclination wall 15*a* is inclined so that its lower end is close to the supplying roller 11, and the toner in the toner container 15 is collected around the supplying roller 11 even when the amount of the toner remaining in the toner container 15 is small.

A toner layer forming roller (atoner layer forming member) 12 is disposed at the upper side of the developing roller 10 in FIG. 2. In other words, the toner layer forming roller 12 is disposed at a downstream side of the supplying roller 11 and an upstream side of the drum 1 in the rotational direction of the drum 1. The outer layer of the toner layer forming roller 12 is made of a rubber having semi-conductivity. The peripheral surface of the toner layer forming roller 12 contacts the peripheral surface of the developing roller 10. A first part (right part as seen in FIG. 2) of the toner layer forming roller 12 is located in the toner container 15, and a second part (left part) of the toner layer forming roller 12 projects out of the toner container 15. The rotational direction of the toner layer forming roller 12 is the same as the rotational direction of the developing roller 10. Further, the circumferential speed of the toner layer forming roller 12 is equal to or lower than the circumferential speed of the developing roller 10. For example, the circumferential speed of the toner layer forming roller 12 is 0.5 to 1.0 times the circumferential speed of the developing roller 10.

Figure 4:
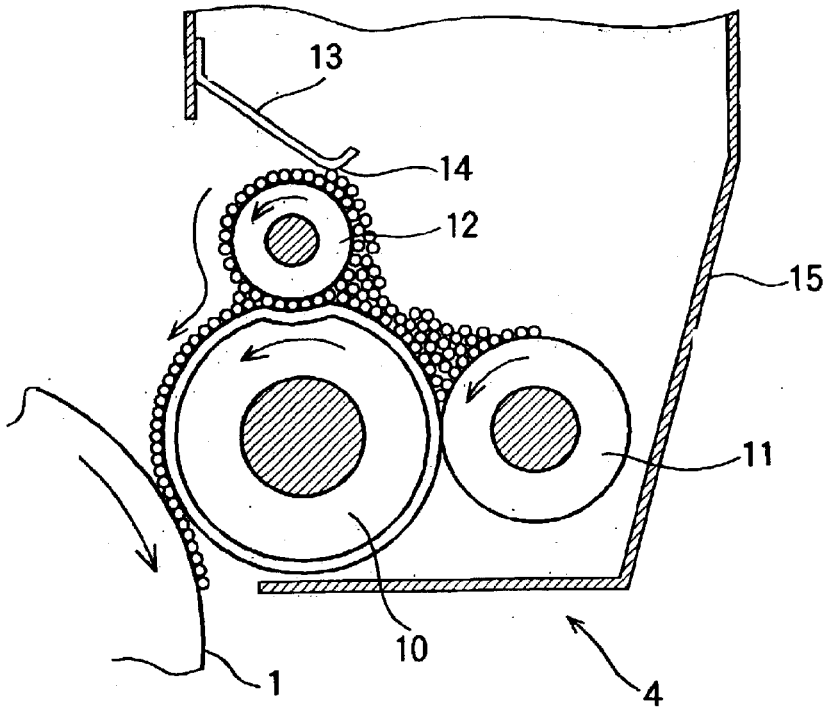
FIG. 4 is a schematic view illustrating the transport of the toner in the developing device according to Embodiment 1 of the present invention.

FIG. 4 is a schematic view illustrating the transport of the toner in the developing device 4. The toner is supplied to the developing roller 10 by the supplying roller 11, and a part of the toner on the developing roller 10 adheres to the peripheral surface of the toner layer forming roller 12. The peripheral surface of the toner layer forming roller 12 preferably has a friction coefficient greater than that of the developing roller 10, with the result that it becomes possible to increase the thickness of the toner layer formed on the toner layer forming roller 12. It means that the releasability of the toner layer forming roller 12 against the toner is lower than that of the developing roller 10. An electric source 42 applies an electric potential VL to the toner layer forming roller 12. There is a difference between the electric potentials VD and VL so that the toner is attracted by the developing roller 10. The electric potentials VD and VL satisfy the relationship $|VD| \leqq |VL|$. In the case where the toner is negatively charged, the electric potential VD is set to −300V, and the electric potential VL is set to −450V.

A blade (a toner layer regulating member) 13 is disposed at the upper side (i.e., an opposite side to the developing roller 10) of the toner layer forming roller 12 in FIG. 4. The blade 13 regulates the thickness of the toner layer formed on the toner layer forming roller 12. The blade 13 is in the form of a plate and is made of a phosphor bronze. The thickness of the blade 13 ranges from 0.06 mm to 0.15 mm.

Figure 5:
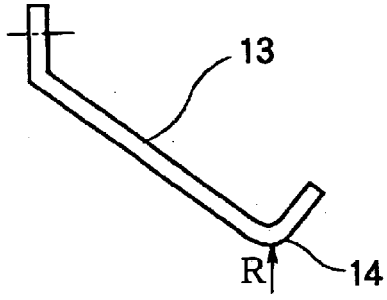
FIG. 5 is an enlarged view of a blade of the developing device according to Embodiment 1 of the present invention.

FIG. 5 is an enlarged view of the blade 13. The upper part of the blade 13 is fixed to an inner surface of a side wall of the toner container 15. The lower part of the blade 13 reaches the proximity of the toner layer forming roller 12, and bends in the direction away from the toner layer forming roller 12 to form a curved contacting surface 14 that faces the toner layer forming roller 12. The contacting surface 14 of the blade 13 extends in parallel to the axis of the toner layer forming roller 12. The cross section of the contacting surface 14 of the blade 13, cut by a plane perpendicular to the longitudinal direction of the blade 13, is in the shape of a circular arc having a radius ranging from 0.3 to 0.5 mm. The contacting surface 14 of the blade 13 is urged against the peripheral surface of the toner layer forming roller 12 with the pressure ranging from 10 to 50 g/cm$^2$. The blade 13 is resiliently deformable in the direction away from the peripheral surface of the toner layer forming roller 12. As shown in FIG. 4, the toner layer passes through the gap between the contacting surface 14 of the blade 13 and the toner layer forming roller 12, so that the thickness of the toner layer becomes uniform. With such an arrangement, the toner layer having a uniform thickness is formed on the toner layer forming roller 12.

The operation of the developing device 4 will be described with reference to FIG. 4. It is assumed that the sufficient amount of the toner is stored in the toner container 15 so that the supplying roller 11 is buried in the toner (FIG. 4 shows only part of the toner). The supplying roller 11 rotates so that the toner stored in the toner container 15 adheres to the peripheral surface of the supplying roller 11. As the supplying roller 11 rotates, the toner that adheres to the peripheral surface of the supplying roller 11 is reaches the proximity of the position where the supplying roller 11 contacts the developing roller 10. The toner is negatively charged by frictional electrification, because of the friction between toner particles, and between the toner particles and the supplying roller 11 or the developing roller 10. The charged toner is attracted by and adheres to the developing roller 10, due to the difference between the electric potentials of the supplying roller 11 and the developing roller 10. Thus, the toner is supplied to the peripheral surface of the developing roller 10.

By the rotation of the developing roller 10, the toner supplied to the peripheral surface of the developing roller 10 reaches the proximity of the position where the developing roller 10 contacts the toner layer forming roller 12. In this contact position, a part of the toner adheres to the peripheral surface of the developing roller 10 because of the difference between the electric potentials of the developing roller 10 and the toner layer forming roller 12, and is carried through the gap between the developing roller 10 and the toner layer forming roller 12 to the drum-side (i.e., the left side in FIG. 4) of the peripheral surface of the developing roller 10, by the rotation of the developing roller 10. Another part of the toner adheres to the peripheral surface of the toner layer forming roller 12, and is carried through the gap between the toner layer forming roller 12 and the blade 13 by the rotation of the toner layer forming roller 12, so that the toner layer having a uniform thickness is formed on the toner layer forming roller 12.

The ratio of the amount of the toner adhering to the developing roller 10 to the amount of the toner adhering to the toner layer forming roller 12 at the position where the developing roller 10 contacts the toner layer forming roller 12 is determined by the friction coefficients, the circumferential speeds and the electric potentials of the developing roller 10 and the toner layer forming roller 12. The circumferential speed of the toner layer forming roller 12 is set to be 0.5 to 1.0 times the circumferential speed of the developing roller 10, so that the thickness and the electrical charge of the toner layer formed on the toner layer forming roller 12 are within the preferable ranges.

By the rotation of the toner layer forming roller 12, the toner layer whose thickness has been regulated by the blade 13 is carried outside the toner container 15 and reaches the proximity of the position where the developing roller 10 contacts the toner layer forming roller 12. The toner layer is transferred to the drum-side (i.e., the left side in FIG. 4) of the peripheral surface of the developing roller 10, because of the difference between the electric potentials of the developing roller 10 and the toner layer forming roller 12. At the drum-side of the peripheral surface of the developing roller 10, the toner transferred from the toner layer forming roller 12 and the toner carried through the gap between the developing roller 10 and the toner layer forming roller 12 are mixed with each other, so that the toner layer having the sufficient thickness is formed on the drum-side of the peripheral surface of the developing roller 10. The thickness of the toner layer formed on the drum-side of the peripheral surface of the developing roller 10 can be varied by changing the friction coefficients, the circumferential speeds and the electric potentials of the developing roller 10 and the toner layer forming roller 12, and by changing the urging force with which the blade 13 is urged against the toner layer forming roller 12.

The toner on the developing roller 10 is attracted by and adheres to the latent image formed on the drum 1. In other words, the latent image on the drum 1 is developed with the toner. The toner that does not adhere to the drum 1 and remains on the peripheral surface of the developing roller 10 is carried to the position where the developing roller 10 contacts the supplying roller 11, according to the rotation of the developing roller 10. Then, the residual toner on the developing roller 10 is removed by the supplying roller 11. The coating layer 10*a* of the developing roller 10 has a small friction coefficient, and therefore the releasability of the developing roller 10 against the toner is improved. Thus, it is ensured that the residual toner on the developing roller 10 is completely removed by the supplying roller 11.

The operation of the electrophotographic apparatus including the developing device 4 will be briefly described with reference to FIG. 1. As the drum 1 rotates, the peripheral surface of the drum 1 is uniformly charged by the charging roller 2, and is exposed by the LED head 3 so that the latent image is formed. The latent image on the peripheral surface of the drum 1 is developed by the developing device 4 as described above, so that the toner image is formed on the peripheral surface of the drum 1. The toner image on the peripheral surface of the drum 1 reaches the position where the toner image faces the transfer roller 5 via the recording sheet (not shown), and is transferred to the recording sheet. The toner image is fixed to the recording sheet by a fixing device (not shown). The residual toner that remains on the drum 1 is removed by the cleaning blade 60.

The result of the printing test using the above described electrophotographic apparatus will be described. In the printing test, the toner is prepared by suspension polymerization method and has a diameter of 7 $\mu$m on average. After the printing is performed continuously on 20000 pages of the recording sheet, the printed image is observed with naked eyes. As a result of the printing test, no afterimage is observed. Further, the filming phenomenon where the toner melts and sticks to the toner layer forming roller 12 and the like does not occur.

Figure 16:
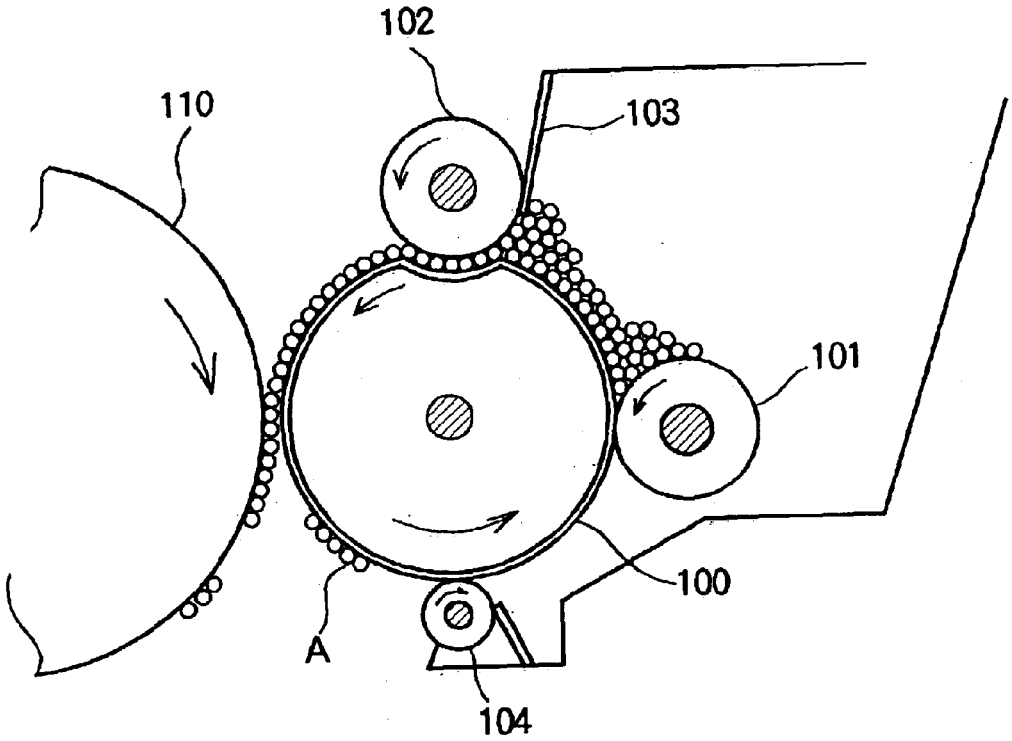
FIG.16 RELATED ART
FIG. 16 is a schematic view illustrating an example of a conventional developing device.

The prevention of the generation of the afterimage according to Embodiment 1 will be detailed. In order to prevent the generation of the afterimage, it is necessary to lower the friction coefficient of the peripheral surface of the developing roller 10 so as to improve the releasability of the developing roller 10 against the toner. However, in the conventional developing device shown in FIG. 16, if the friction coefficient of the peripheral surface of the developing roller 100 is low, only a small amount of the toner is carried to the drum-side of the peripheral surface of the developing roller 100. This may cause a defect in the transferred image. However, according to Embodiment 1, the toner layer is formed on the peripheral surface of the toner layer forming roller 12 as shown in FIG. 4, and is carried to the drum-side of the peripheral surface of the developing roller 10 by the rotation of the toner layer forming roller 12. Thus, even if the friction coefficient of the peripheral surface of the developing roller 10 is low, it is possible to carry a sufficient amount of toner to the drum-side of the peripheral surface of the developing roller 10, and therefore the defect in the image can be prevented. By lowering the friction coefficient of the developing roller 10, the releasability of the developing roller 10 against the toner can be improved, and therefore it is ensured that the residual toner on the developing roller 10 can be completely removed.

Figure 6:
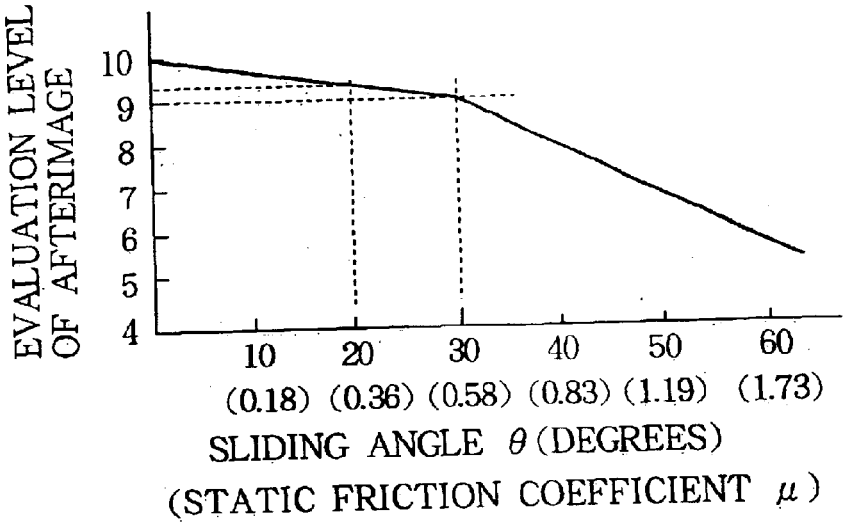
FIG. 6 is a graphic chart illustrating the relationship between the friction coefficient of the developing roller and the generation of the afterimage according to Embodiment 1 of the present invention.

The relationship between the friction coefficient of the developing roller 10 and the generation of the afterimage will be described in detail. FIG. 6 is a graphic chart illustrating the experimental result of the generation of the afterimage when the static friction coefficient $\mu$ is varied. In FIG. 6, the horizontal axis indicates the sliding angle $\theta$ corresponding to the static friction coefficient $\mu$ measured by means of the tilting plate 31 shown in FIG. 3. The vertical axis indicates the evaluation level of the afterimage. The evaluation level is determined based on the presence and the density of the afterimage observed in the printed image. When no afterimage is observed with naked eyes, the evaluation level is 10. The evaluation level decreases as the afterimage becomes dense. When the afterimage is slightly observed with naked eyes but the after image is at a level that does not cause a problem in practical use, the evaluation level is 9.

According to FIG. 6, the evaluation level is equal to or greater than 9 when the static friction coefficient $\mu$ is equal to or less than 0.58 with respect to the surface of the tilting plate 31 (i.e., a flat plate of an acryl resin having an average surface roughness Rz of approximately 2 $\mu$m). In other words, the sliding angle $\theta$ is equal to or less than 30 degrees. When the static friction coefficient $\mu$ is within this range, the releasability of the developing roller 10 against the toner is relatively high, and therefore it is ensured that the residual toner on the developing roller 10 can be removed by the supplying roller 11. Further, the evaluation level is equal to or greater than 9.5 when the static friction coefficient $\mu$ with respect to the surface of the tilting plate 31 is equal to or less than 0.36, i.e., the sliding angle θ is equal to or less than 20 degrees. As a result, the static friction coefficient $\mu$ is preferably equal to or less than 0.58, and further preferably equal to or less than 0.36. In the printing test for obtaining the result shown in FIG. 6, the toner layer forming roller 12 having a static friction coefficient $\mu$ of 0.58 (i.e., the sliding angle 0 of 30 degrees) is used.

The effect of the prevention of the filming phenomenon according to Embodiment 1 will be described in detail. In the conventional fixing device shown in FIG. 16, the blade 103 scrapes the toner from the peripheral surface of the toner regulating roller 102, and therefore the blade 103 must be urged against the toner regulating roller 102 with a relatively strong force. It may cause the filming phenomenon where the toner is melted by the friction heat and sticks to the toner layer forming roller 12 and the like. In contrast, according to Embodiment 1, the blade 13 is urged against the toner layer forming roller 12 with a relatively weak force so that the toner layer having a certain thickness can pass through the gap between the toner layer forming roller 12 and the blade 13. Thus, the generation of the friction heat is small, with the result that the filming phenomenon does not occur. In particular, as the outer layer of the toner layer forming roller 12 is made of a rubber, it is ensured that the generation of the filming phenomenon can be prevented.

As described above, according to Embodiment 1, the toner layer whose thickness is regulated is formed on the toner layer forming roller 12, and is transferred to the drum-side of the peripheral surface of the developing roller 10. With such an arrangement, even if the friction coefficient of the developing roller 10 is low, it is possible to carry the sufficient amount of toner to the drum-side of the peripheral surface of the developing roller 10. Accordingly, the releasability of the developing roller 10 against the toner is sufficiently high, and therefore the residual toner on the peripheral surface of the developing roller 10 can be removed by the supplying roller 11. As a result, the generation of the afterimage is prevented, with the result that the degradation of the quality of the image can be prevented.

In addition, the thickness of the toner layer formed on the drum-side of the peripheral surface of the developing roller 10 can be controlled by adjusting the friction coefficients, the circumferential speeds or the electric potentials of the developing roller 10 and the toner layer forming roller 12, and by adjusting the urging force with which the blade 13 is urged against the toner layer forming roller 12. Thus, the thickness of the toner that adheres to the latent image of the drum 1 can be adjusted, so that the density of the toner image formed on the recording sheet can be adjusted.

Moreover, according to Embodiment 1, the blade 13 can be urged against the toner layer forming roller 12 with a relatively weak force, and therefore it is possible to prevent the filming phenomenon where the toner melts and sticks to the toner layer forming roller 12 and the like due to the friction heat. Thus, the degradation of the quality of the image can be prevented.

Furthermore, the toner layer formed on the peripheral surface of the toner layer forming roller 12 is carried outside the toner container 15, and is transferred to the developing roller 10 at the exterior of the toner container 15. Thus, it is possible to prevent an additional toner from adhering to the toner layer whose thickness has been regulated by the blade 13. As a result, the thickness of the toner layer becomes uniform.

Additionally, the releasability of the developing roller 10 against the toner is greater than that of the toner layer forming roller 12. Thus, the residual toner on the developing roller 10 can be easily removed, so that the generation of the afterimage can be prevented. Further, a large amount of the toner can be carried by the toner layer forming roller 12.

In particular, the developing roller 10 is provided with the coating layer 10*a* having the static friction coefficient $\mu$ equal to or less than or 0.58 (preferably, 0.36) with respect to the flat surface of acrylic resin having the average surface roughness Rz of approximately 2 $\mu$m. Thus, it is possible to prevent the generation of the afterimage that may cause a problem in practical use.

Further, by the provision of the blade 13, it is possible to regulate the thickness of the toner layer on the peripheral surface of the toner layer forming roller 12 with a simple construction. In particular, the radius of curvature of the contacting surface 14 of the blade 13 ranges from 0.3 to 0.5 mm, and the urging pressure with which the blade 13 is urged against the toner layer forming roller 12 ranges from 10 to 50 g/cm$^2$, with the result that the toner layer formed on the toner layer forming roller 12 has a uniform thickness.

In addition, electric potentials are applied to the developing roller 10 and the toner layer forming roller 12 so that the toner is transferred from the toner layer forming roller 12 to the developing roller 10. Thus, even if the friction coefficient of the toner layer forming roller 12 is greater than that of the developing roller 10, it is ensured that the toner layer formed on the toner layer forming roller 12 is transferred to the developing roller 10.

Moreover, the circumferential speed of the toner layer forming roller 12 is less than that of the developing roller 10 (for example, 0.5 to 1.0 times the circumferential speed of the developing roller 10), so that the thickness of the toner layer formed on the developing roller 10 can be in the preferable range.

Embodiment 2.

Figure 7:
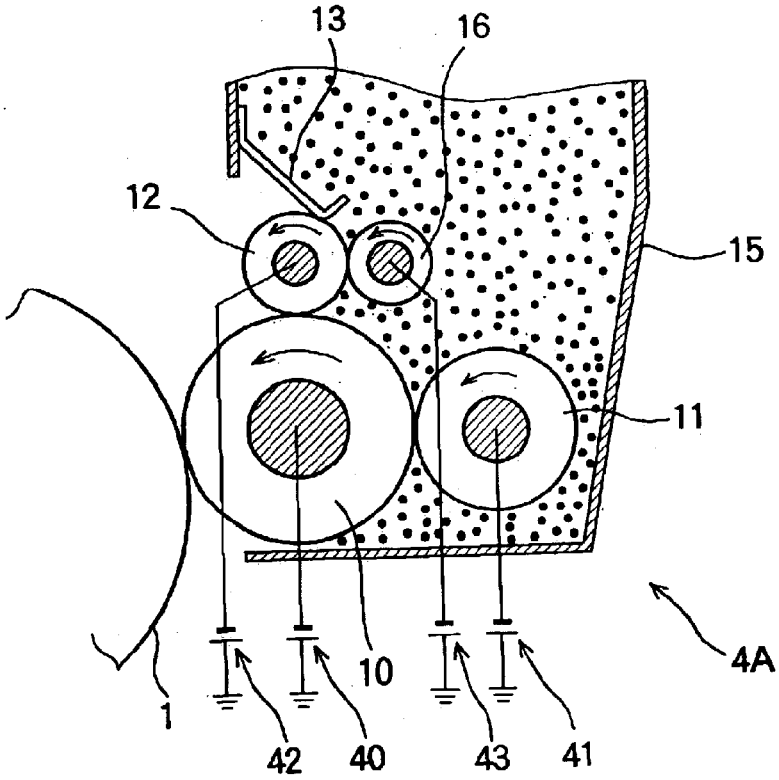
FIG. 7 is an enlarged view of the developing device according to Embodiment 2 of the present invention.

FIG. 7 is an enlarged view of the developing device 4A according to Embodiment 2 of the present invention. The developing device 4A has an auxiliary supplying roller (an auxiliary supplying member) 16 adjacent to the toner layer forming roller 12, in addition to the components of the developing device (FIG. 2) of Embodiment 1. Except the provision of the auxiliary supplying roller 16, the construction of the fixing device 4A is the same as the that of the fixing device 4 of Embodiment 1. The fixing device 4A is mounted to the electrophotographic apparatus (FIG. 1) described in Embodiment 1.

The auxiliary supplying roller 16 is disposed in the toner container 15, and contacts the right side of the peripheral surface of the toner layer forming roller 12 in FIG. 2. The auxiliary supplying roller 16 has a rotation axis in parallel to the rotation axis of the toner layer forming roller 12, and rotates in the same direction as the toner layer forming roller 12. The auxiliary supplying roller 16 is made of a semi-conductive silicone resin having intercommunicating pores, i.e., a so-called silicone sponge. An electric source 43 applies the electric potential VH to the auxiliary supplying roller 16. As was described in Embodiment 1, the electric sources 40, 41 and 42 respectively apply electric potentials VD, VS and VL to the developing roller 10, the supplying roller 11 and the toner layer forming roller 12. There is a difference between the electric potential VH of the auxiliary supplying roller 16 and the electric potential VL of the toner layer forming roller 12 so that the toner is attracted by the toner layer forming roller 12. In particular, the electric potentials VH and VL are determined to satisfy the relationship |VH|≧|VL|. The polarities of the electric potentials VH and VL are the same as the polarity of the toner.

The auxiliary supplying roller 16 rotates in contact with the toner layer forming roller 12, in such a manner that the toner stored in the toner container 15 adheres to the peripheral surface of the auxiliary supplying roller 16. The toner layer adhered to the peripheral surface of the auxiliary supplying roller 16 is carried to the position where the auxiliary supplying roller 16 contacts the toner layer forming roller 12, and negatively charged by the friction between the toner particles and the like. The charged toner is attracted by and adheres to the toner layer supplying roller 12, due to the potential difference between the auxiliary supplying roller 16 and the toner layer forming roller 12. Thus, in addition to the toner carried by the developing roller 10, the toner carried by the auxiliary supplying roller 16 is supplied to the peripheral surface of the toner layer forming roller 12. As was described in Embodiment 1, the blade 13 regulates the thickness of the toner adhering to the peripheral surface of the toner layer forming roller 12. The toner layer formed on the toner layer forming roller 12 is carried out of the toner container 15, and is transferred to the drum-side of the peripheral surface of the developing roller 10. The toner on the drum-side of the peripheral surface of the developing roller 10 adheres to the latent image of the drum 1.

According to Embodiment 2, the toner carried by the auxiliary supplying roller 16 is supplied to the peripheral surface of the toner layer forming roller 12. Thus, even if only a small amount of the toner is supplied by the supplying roller 11 to the developing roller 10 (for example, because of the uneven distribution of the toner in the toner container 15), it is possible to supply a sufficient amount of the toner to the drum-side of the peripheral surface of the developing roller 10, via the auxiliary supplying roller 16 and the toner layer forming roller 12. Accordingly, it is possible to prevent the defect in the toner image due to the shortage of the toner.

Generally, the shortage of the toner on the peripheral surface of the developing roller 10 causes a so-called reversal afterimage in which a part of the image corresponding to the former printed image has a low density. However, according to Embodiment 2, the reversal afterimage can be prevented, because the sufficient amount of the toner is supplied to the developing roller 10.

Moreover, as was described in Embodiment 1, the friction coefficient of the peripheral surface of the developing roller 10 can be relatively small, so that the residual toner on the developing roller 10 is easily removed, and therefore the generation of the afterimage can be prevented. Further, the urging force with which the blade 13 is urged against the toner layer forming roller 12 is relatively small, so that it is possible to prevent the filming phenomenon caused by the melting of the toner by the friction heat. Thus, the degradation of the quality of the image can be prevented.

Embodiment 3.

Figure 8:
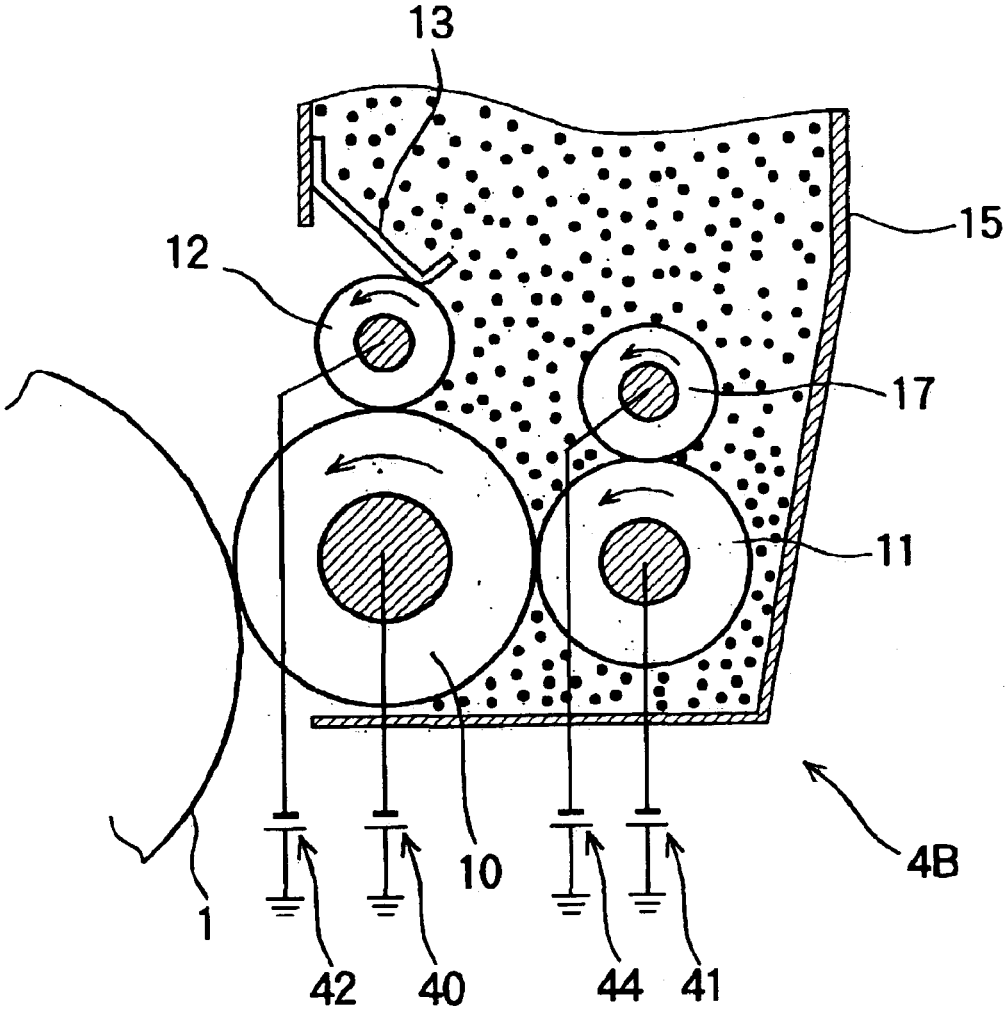
FIG. 8 is an enlarged view of the developing device according to Embodiment 3 of the present invention.

FIG. 8 is an enlarged view of the fixing device 4B according to Embodiment 3 of the prevent invention. The fixing device 4B has an additional supplying roller (an additional supplying member) 17 adjacent to the supplying roller 11, in addition to the components of the fixing device 4 (FIG. 2) of Embodiment 1. Except the provision of the additional supplying roller 17, the construction of the fixing device 4B is the same as that of the fixing device 4 (FIG. 2) of Embodiment 1. The fixing device 4B is mounted to the electrophotographic apparatus (FIG. 1) described in Embodiment 1.

The additional supplying roller 17 is disposed in the toner container 15, and contacts the upper side of the peripheral surface of the supplying roller 11 in FIG. 8. The additional supplying roller 17 has a rotation axis in parallel to the rotation axis of the supplying roller 11, and rotates in the same direction as the supplying roller 11. As is the case with the supplying roller 11, the additional supplying roller 17 is constructed of a semi-conductive urethane resin having intercommunicating pores (i.e., a so-called urethane sponge) An electric source 45 applies the electric potential VT to the additional supplying roller 17. As was described in Embodiment 1, the electric sources 40, 41 and 42 respectively apply electric potentials VD, VS and VL to the developing roller 10, the supplying roller 11 and the toner layer forming roller 12. There is a potential difference between the electric potential VT of the additional supplying roller 17 and the electric potential VS of the supplying roller 11 so that the toner is attracted by the supplying roller 11. In particular, the electric potentials VT and VS are determined to satisfy the relationship |VT|≧|VS|. The polarities of the electric potentials VT and VS are the same as the polarity of the toner.

The additional supplying roller 17 rotates in contact with the supplying roller 11, in such a manner that the toner stored in the toner container 15 adheres to the peripheral surface of the additional supplying roller 17. The toner layer adhered to the peripheral surface of the additional supplying roller 17 is carried to the position where the additional supplying roller 17 contacts the supplying roller 11, and negatively charged by the friction between the toner particles and the like. The charged toner is attracted by and adheres to the supplying roller 11, due to the potential difference between the additional supplying roller 17 and the supplying roller 11. Thus, the sufficient amount of the toner is supplied to the peripheral surface of the supplying roller 11.

According to Embodiment 3, the toner is supplied to the supplying roller 11 by the additional supplying roller 17. Thus, if only a small amount of the toner exists around the supplying roller 11 (for example, because of the uneven distribution of the toner in the toner container 15), a sufficient amount of the toner can be supplied to the supplying roller 11 by means of the additional supplying roller 17. Accordingly, it is possible to prevent the defect of the image because of the shortage of the toner, and to prevent the generation of the above described reversal afterimage.

Moreover, as was described in Embodiments 1 and 2, the friction coefficient of the peripheral surface of the developing roller 10 is relatively small, so that the residual toner on the developing roller 10 can be easily removed, and therefore the generation of the afterimage can be prevented. Further, the urging force with which the blade 13 is urged against the toner layer forming roller 12 is relatively small, so that it is possible to prevent the filing phenomenon caused by the melting of the toner by the friction heat. Thus,the degradation of the quality of an image can be prevented.

Embodiment 4.

In Embodiment 4 of the present invention, the preferable range of the urging force with which the toner layer forming roller 12 is urged against the developing roller 10 is determined.

If the developing roller 10 stops for a long time while the developing roller 10 contacts the drum 1 or the toner layer forming roller 12, the peripheral surface of the developing roller 10 may be partially deformed by the contact pressure, so that a dent may be formed on the peripheral surface of the developing roller 10. The dent is substantially elongated in the axial direction of the developing roller 10. The thickness of the toner layer formed on the drum-side of the peripheral surface of the developing roller 10 is influenced by the amount of the toner that passes through the gap between the developing roller 10 and the toner layer forming roller 12. Thus, if the dent is formed on the peripheral surface of the developing roller 10, the thickness of the toner layer on the drum-side of the peripheral surface of the developing roller 10 becomes uneven, so that a lateral stripe may appear in the printed image on the recording sheet. The lateral stripe is elongated in the direction parallel to the axis of the developing roller 10. Moreover, if the diameter of the toner layer forming roller 12 changes due to the wear caused by the continuous printing, the thickness of the toner layer on the developing roller 10 may change. In Embodiment 4, the preferable range of the urging force is determined for preventing the generation of the lateral stripe and for preventing the change of the thickness of the toner layer.

Figures 9, 10:
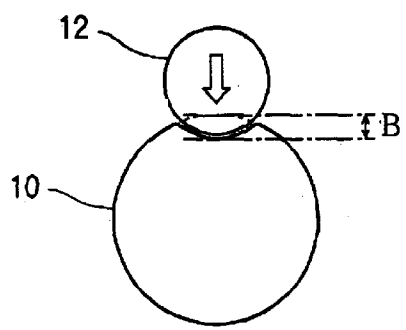
FIG. 9 is a table illustrating the experimental result of the generation of a lateral stripe according to Embodiment 4 of the present invention.
FIG. 10 is a schematic view illustrating the concept of a pushing amount of the toner layer forming roller.

FIG. 9 shows the experimental result of the generation of the lateral stripe. The urging force with which the toner layer forming roller 12 is urged against the developing roller 10 is represented by a pushing amount of the toner layer forming roller 12 against the developing roller 10. As schematically shown in FIG. 10, the pushing amount means an amount B by which the toner layer forming roller 12 is pushed against the developing roller 10 causing the deformation of the developing roller 10. The toner layer forming roller 12 is rotatably supported by a not-shown supporting member, and the position of the supporting member is adjusted for varying the above-described pushing amount. The pushing amount is varied from 0 to 0.5 mm.

In FIG. 9, the dent is formed on the developing roller 10, and the depth of the dent is varied from 0 to 10 $\mu$m. The dent is formed by stopping the developing roller 10 in contact with the toner layer forming roller 12. The depth of the dent is varied by changing the duration (time) while the developing roller 10 stops rotating in contact with the toner layer forming roller 12. The lateral stripe in the printed image is observed with naked eyes.

As shown in FIG. 9, when the pushing amount is 0.1 mm, the lateral stripe is not observed in the case where the developing roller 10 has no dent, but the lateral stripe is observed in the cases where the depth of the dent on the developing roller 10 is from 3 to 10 $\mu$m.

When the pushing amount is 0.2 mm, the lateral stripe is not observed in the cases where the depth of the dent on the developing roller 10 is from 0 to 8 $\mu$m. A slight lateral stripe is observed in the case where the depth of the dent on the developing roller 10 is 10 $\mu$m, but the density of the lateral stripe is at the level that does not cause a problem in practical use.

When the pushing amount is 0.3 mm and 0.4 mm, the lateral stripe is not observed in the cases where the depth of the dent on the developing roller 10 is from 0 to 10 $\mu$m.

When the pushing amount is 0.5 mm, the toner layer forming roller 12 can not rotate because the large torque is required for rotating the toner layer forming roller 12.

According to the experimental result shown in FIG. 9, it is possible to form an excellent image having no lateral stripe when the pushing amount is equal to or greater than 0.2 mm. This is because the toner layer forming roller 12 sufficiently contacts the peripheral surface of the developing roller 10 via the toner layer even when the dent is formed on the peripheral surface of the developing roller 10.

FIG. 11 shows the experimental result of the change in the thickness of the toner layer formed on the drum-side of the peripheral surface of the developing roller 10. The thickness of the toner layer on the developing roller 10 is measured after the printing is performed on 0, 5000, 10000, 15000 and 20000 pages of the recording sheet. The thickness of the toner layer is expressed by an amount (weight) of the toner per unit area of the peripheral surface of the developing roller 10.

As shown in FIG. 11, when the pushing amount is 0.2 mm and 0.3 mm, the thickness of the toner layer on the developing roller 10 does not change as the number of the printed pages increases. Conversely, when the pushing amount is 0.1 mm, the thickness of the toner layer on the developing roller 10 increases as the number of the printed pages increases.

According to Embodiment 4, the pushing amount of the toner layer 12 against the developing roller 10 is preferably equal to or greater than 0.2 mm, with the result that the generation of the lateral stripe in the image can be prevented, and therefore the quality of the image can be improved.

Embodiment 5.

Figure 12:
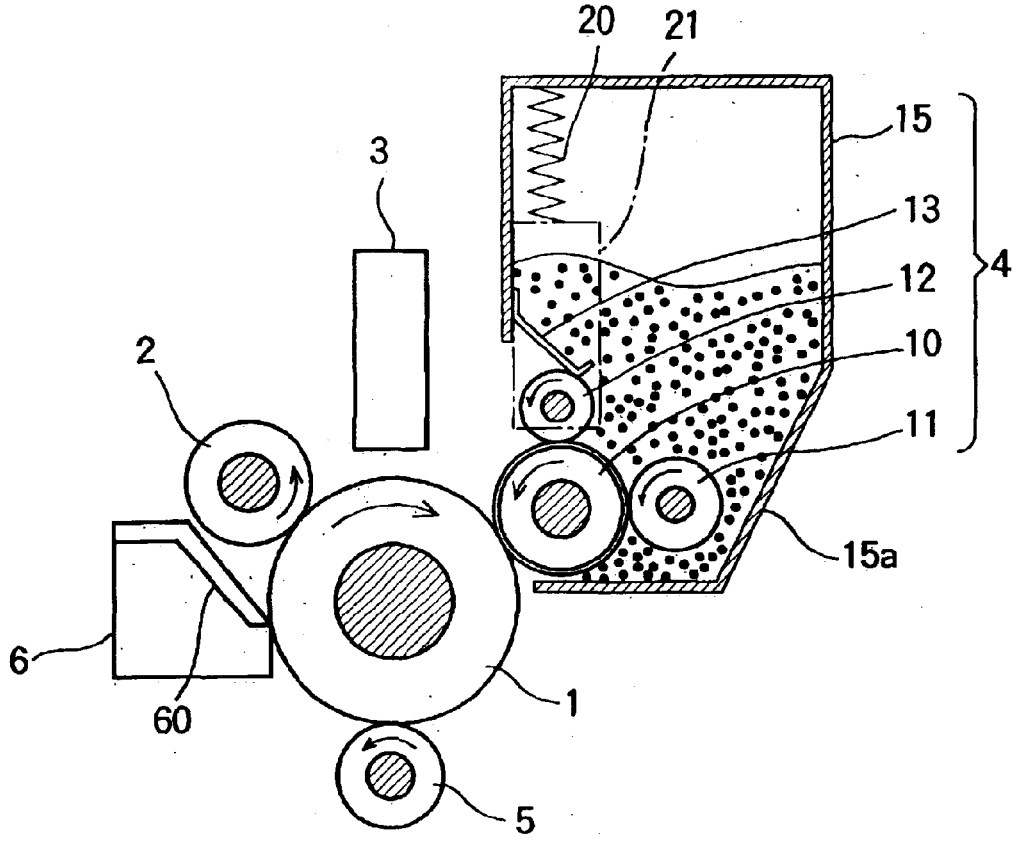
FIG. 12 is a sectional view of an electrophotographic apparatus including a developing device according to Embodiment 5 of the present invention.

FIG. 12 is a sectional view of the main part of the electrophotographic apparatus including a developing device according to Embodiment 5. In Embodiment 5, the toner layer forming roller 12 is urged against the developing roller 10 by means of springs (an urging mechanism) 20.

Figure 13:
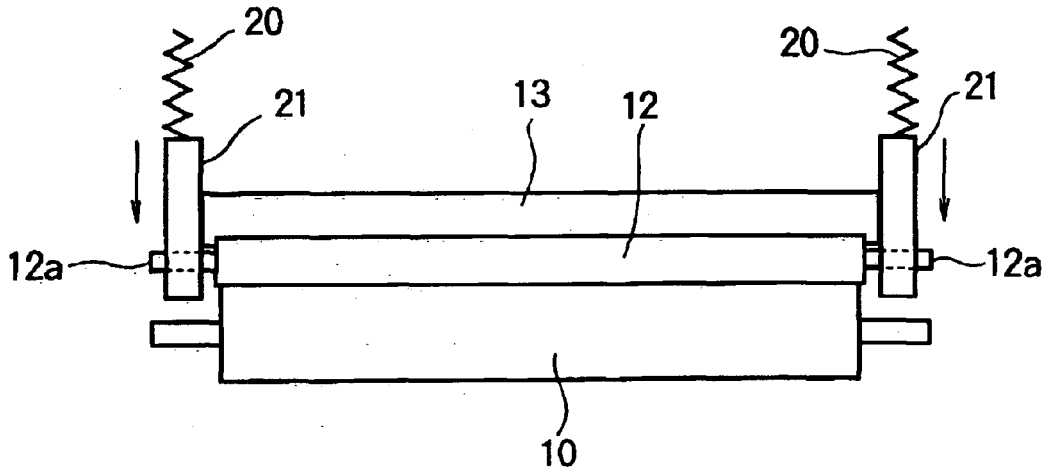
FIG. 13 is a front view of the main part of the developing device according to Embodiment 5 of the present invention.

FIG. 13 is a front view of the developing roller 10, the toner layer forming roller 12 and the blade 13 of the developing device according to Embodiment 5. Both ends of the main shaft 12*a* of the toner layer forming roller 12 are rotatably supported by a pair of movable frames 21. Further, the blade 13 is supported by the frames 21, so that the toner layer forming roller 12 and the blade 13 constitute one unit. The frames 21 are movable in the direction toward and away from the peripheral surface of the developing roller 10, and urged in the direction toward the developing roller 10 by means of the springs 20.

In Embodiment 5, even if the dent is formed on the peripheral surface of the developing roller 10 as described in Embodiment 4, the toner layer forming roller 12 follows the peripheral surface of the developing roller 10, because the toner layer forming roller 12 is movable toward and away from the developing roller 10 and is urged against the developing roller 10 by the force of the spring 20. Thus, the thickness of the toner layer on the developing roller 10 becomes uniform, so that the generation of the lateral stripe in the printed image can be prevented. As a result, the quality of the image can be improved.

Further, even when the dent is formed on the developing roller 10 by the abrasion after a large number of pages are printed, the thickness of the toner layer is uniform because of the above-described construction, with the result that the quality of the image can be improved.

FIG. 14 shows the experimental result of the generation of the lateral stripe. The depth of the dent on the developing roller 10 is varied from 0 to 10 $\mu$m. The toner layer forming roller 12 is urged by the springs 20 against the developing roller 10 so that the pushing amount (defined in Embodiment 4 with reference to FIG. 10) ranges from 0.1 to 0.4 mm. For comparison, the experimental result on the developing device of Embodiment 4 (when the pushing amount is 0.2 mm) is also shown in FIG. 14. As shown in FIG. 14, according to Embodiment 5, the lateral stripe is not observed when the depth of the dent on the developing roller 10 is from 0 to 10 $\mu$m. In contrast, the lateral stripe is slightly observed in the experimental result on Embodiment 4 when the depth of the dent on the developing roller 10 is 10 $\mu$m. As a result, the developing device according to Embodiment 5 is capable of effectively preventing the generation of the lateral stripe.

FIG. 15 shows the experimental result of the change in the thickness of the toner layer formed on the developing roller 10. The thickness of the toner layer on the developing roller 10 is measured after the printing is performed on 0, 5000, 10000, 15000 and 20000 pages of the recording sheet, as was described in Embodiment 4. The toner layer forming roller 12 is urged by the springs 20 against the developing roller 10 so that the pushing amount ranges from 0.1 to 0.4 mm. For comparison, the experimental result on the developing device of Embodiment 4 (when the pushing amount is 0.2 mm) is also shown in FIG. 15. As shown in FIG. 15, according to Embodiment 5, the thickness of the toner layer on the developing roller 10 does not change as the number of printed pages increases, as is the case with Embodiment 4.

The torque required for rotating the toner layer forming roller 12 of the developing device according to Embodiment 5 will be described. When the toner layer forming roller 12 is urged by the springs 20 against the developing roller 10 so that the pushing amount ranges from 0.1 to 0.4 mm, the torque required for rotating the toner layer forming roller 12 is 3.5 kgf. For comparison, the torque required for rotating the toner layer forming roller 12 of the developing device of Embodiment 4 when the pushing amount is 0.2 mm is 4.7 kgf.

According to Embodiment 5, the toner layer forming roller 12 is movable toward and away from the developing roller 10 and is urged against the developing roller 10 by the force of the spring 20, with the result that the thickness of the toner layer on the developing roller 10 becomes uniform. Further, the toner layer forming roller 12 can be rotated with a relatively small torque.

In the above described Embodiments 1 through 5, the developing roller 10, the supplying roller 11 and the toner layer forming roller 12, the auxiliary supplying roller 16 and the additional supplying roller 17 are not necessarily in the form of rollers that entirely rotate, but can be cylindrical rotatable sleeves, endless belts and the like.

While the preferred embodiments of the present invention have been illustrated in detail, it should be apparent that modifications and improvements may be made to the invention without departing from the spirit and scope of the invention as described in the following claims.

What is claimed is:

1. A developing device comprising:

a developing member that develops a latent image formed on a latent image bearing member;

a toner supplying member that supplies a toner to said developing member;

a toner layer forming member that has a peripheral surface contacting said developing member; and a toner layer regulating member that regulates the thickness of a toner layer that adheres to said peripheral surface of said toner layer forming member, wherein said toner layer is transferred from said peripheral surface of said toner layer forming member to a peripheral surface of said developing member, after the thickness of said toner layer has been regulated by said toner layer regulating member.

2. The developing device according to claim 1, further comprising a toner container for storing said toner, wherein said toner supplying member supplies said toner to said developing member, said toner layer is formed on said toner layer forming member, and said toner layer regulating member regulates the thickness of said toner layer on said toner layer forming member in said toner container, and wherein, said toner layer forming member carries said toner layer, the thickness of which has been regulated by said toner layer regulating member, to the exterior of said toner container, and said toner layer is transferred to said developing member at the exterior of said container.

3. The developing device according to claim 1, wherein said developing member rotates in a certain direction, and said toner layer forming member rotates in the same direction as said developing member, and wherein, as said developing member rotates, a part of said toner supplied to said developing member by said toner supplying member is carried through a gap between said developing member and said toner layer forming member in the rotational direction of said developing member, and is mixed with said toner layer transferred from said toner layer forming member.

4. The developing device according to claim 1, further comprising means for applying electric potentials to said developing member and said toner layer forming member for transferring said toner layer from said toner layer forming member to said developing member.

5. The developing device according to claim 1, wherein each of said developing member, said toner layer forming member and said toner supplying member is in the form of a roller.

6. The developing device according to claim 1, wherein the releasability of said peripheral surface of said developing member is greater than the releasability of said peripheral surface of said toner layer forming member.

7. The developing device according to claim 1, wherein the surface roughness of said peripheral surface of said developing member is less than that of said toner layer forming member.

8. The developing device according to claim 1, wherein said developing member has an outer layer made of a resin.

9. The developing device according to claim 1, wherein said toner layer forming member has an outer layer made of a rubber.

10. The developing device according to claim 1, wherein said toner layer forming member is pushed against said developing member, and a pushing amount of said toner layer forming member is equal to or greater than 0.2 mm.

11. The developing device according to claim 1, further comprising an urging mechanism that resiliently urges said toner layer forming member against said developing member.

12. The developing device according to claim 1, wherein the static friction coefficient of said peripheral surface of said developing member is equal to or less than 0.58, with respect to a flat surface of an acryl resin having an average surface roughness of approximately 2 $\mu$m.

13. The developing device according to claim 12, wherein the static friction coefficient of said peripheral surface of said developing member is equal to or less than 0.36, with respect to a flat surface of an acryl resin having an average surface roughness of approximately 2 $\mu$m.

14. The developing device according to claim 1, wherein the circumferential speed of said peripheral surface of said toner layer forming member is less than that of said developing member.

15. The developing device according to claim 1, wherein said toner layer regulating member includes a blade that contacts said peripheral surface of said toner layer forming member, and said blade has a contacting surface that faces said toner layer forming member and extends in a longitudinal direction of said toner layer forming member.

16. The developing device according to claim 15, wherein a cross section of said contacting surface of said blade perpendicular to said longitudinal direction of said blade is curved and has a radius of curvature in a range from 0.3 to 0.5 mm.

17. The developing device according to claim 15, said blade is urged against said toner layer forming member with a pressure in a range from 10 to 50 g/cm$^2$.

18. The developing device according to claim 1, further comprising means for applying electric potentials VD, VS and VL to said developing member, said toner supplying member and said toner layer forming member, and said electric potentials VD, VS and VL satisfy the following relationships (1) and (2).

$$|VD| \leqq |VS| \quad (1)$$

$$|VD| \leqq |VL| \quad (2)$$

19. The developing device according to claim 1, further comprising an auxiliary supplying member that supplies said toner to said toner layer forming member.

20. The developing device according to claim 19, wherein said auxiliary supplying member contacts said peripheral surface of said toner layer forming member, and rotates in the same direction as said toner layer forming member.

21. The developing device according to claim 19, wherein electric potentials VH and VL are respectively applied to said auxiliary supplying member and said toner layer forming member, and said electric potentials VH and VL satisfy the following relationship (3).

$$|VH| \geqq |VL| \quad (3)$$

22. The developing device according to claim 1, further comprising an additional supplying member that supplies said toner to said toner supplying member.

23. The developing device according to claim 22, wherein said additional supplying member contacts said peripheral surface of said toner supplying member and rotates in the same direction as said toner supplying member.

24. The developing device according to claim 23, wherein electric potentials VT and VS are respectively applied to said additional supplying member and said toner supplying member, and said electric potentials VT and VS satisfy the following relationship (4).

$$|VT| \geqq |VS| \quad (4)$$

25. The developing device according to claim 1, wherein said developing member rotates in a certain direction, and said toner layer forming member rotates in the same direction as said developing member.

26. An electrophotographic apparatus comprising:

said developing device according to claim 1;

said latent image bearing member that carries a latent image developed by said developing device; and a transfer device that transfers said toner image developed by said developing device to a recording medium.

* * * * *